United States Patent [19]

Daugherty et al.

[11] 4,012,998

[45] Mar. 22, 1977

[54] CARTON SEALING METHOD AND APPARATUS

[75] Inventors: Ralph K. Daugherty; Lynn D. Crawford, both of San Jose, Calif.

[73] Assignees: Genevieve I. Hanscom; Genevieve I. Hanscom, Robert M. Magnuson & Lois J. Thomson, Trustees of the Estate of Roy M. Magnuson, all of Calif. ; part interest to each

[22] Filed: Sept. 17, 1975

[21] Appl. No.: 614,351

[52] U.S. Cl. ..... 93/39 R; 93/44; 93/55.1 P

[51] Int. Cl.[2] ..... B31B 17/02

[58] Field of Search ..... 93/55.1 P, 55.1 R, 55, 93/39.1 P, 39.1 R, 39 R, 44; 53/42, 290, 374, 287

[56] References Cited

UNITED STATES PATENTS

| | | | |
|---|---|---|---|
| 3,380,228 | 4/1968 | Platt | 93/55.1 R |
| 3,816,973 | 6/1974 | Baker | 53/287 |
| 3,896,607 | 7/1975 | Royal | 93/55.1 P X |
| 3,927,505 | 12/1975 | Bemiss | 53/37 |

*Primary Examiner*—James F. Coan
*Attorney, Agent, or Firm*—Gerald L. Moore

[57] ABSTRACT

Apparatus for bringing together a tray and separate lid to form a carton wherein the lid is moved into position above the tray and the lid side flaps are bent down along the tray side panels and fastened in place to form the carton.

9 Claims, 13 Drawing Figures

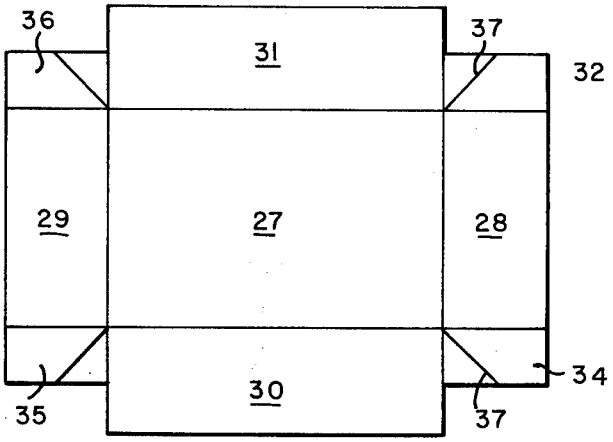
FIG. 2
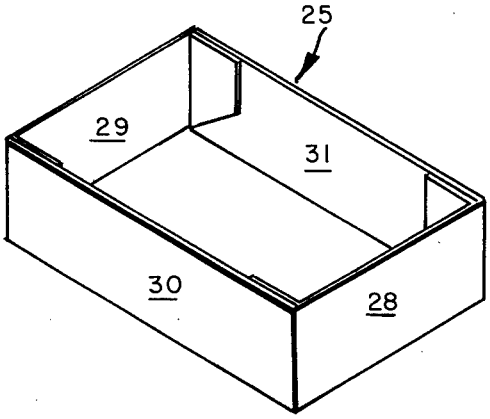
FIG. 3
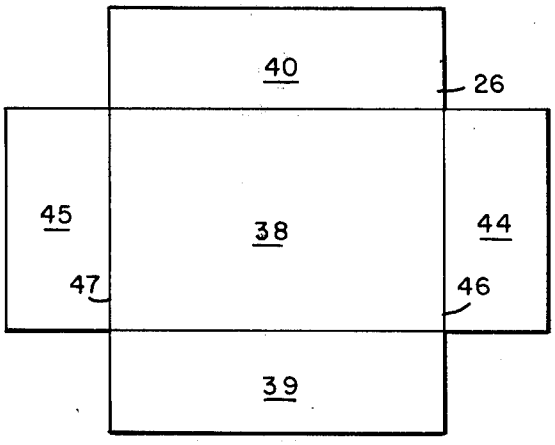
FIG. 4
FIG. 5
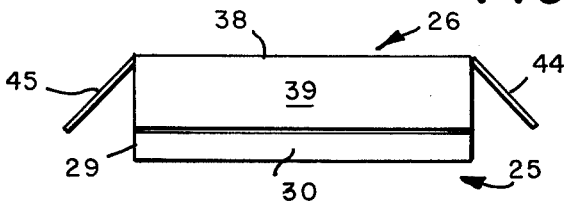

CARTON SEALING METHOD AND APPARATUS

CROSS-REFERENCE TO RELATED APPLICATIONS

Application Ser. No. 614,352, filed Sept. 17, 1975, entitled TRAY BLANK FEEDER, Ralph K. Daugherty. inventor and assigned to Magnuson Engineers, Inc.

Application Ser. No. 614,336, filed Sept. 17, 1975, entitled DEVICE FOR ACCELERATING AND TIMING ARTICLES, Lynn. D. Crawford and Ralph K. Daugherty, inventors, and assigned to the same assignee.

Application Ser. No. 614,433, filed Sept. 17, 1975, entitled APPARATUS FOR FORMING TRAYS, Lynn D. Crawford, inventor and assigned to the same assignee.

BACKGROUND OF THE INVENTION

In forming cartons or packages for such products as frozen foods, most prior containers have been fabricated from a one-piece blank wherein a lid is formed contiguous with the tray blank and, after forming and filling the tray, the lid is folded over to complete the closure of the package. Because of various advantages, there is now being used a package comprising a tray and a separately formed lid with the two components being fixed together after the tray is filled.

Of various advantages derived from the two piece carton the primary advantage involves the easier handling of the tray. Naturally if a lid is fixed to the tray, it must be conveyed therewith in the open position during the filling operation thereby greatly complicating the handling and filling of the container. In addition, with many products the nomenclature or identification of the product can be printed directly on the lid requiring the lid to be made of better paper stock. With the two-piece construction, the tray can be made of a lower grade stock which is less expensive. Also with printing on the lid, the lid only need be changed as the product for filling the tray is changed to change the identification of the carton contents.

However, after filling the tray of the two-piece carton, the lid must be brought into the proper position and fixed to the tray to complete the sealing of the container. If the forming apparatus can be made to operate at faster and more efficient speeds, the packaging process is made more economical. This result is derived from the fact that fewer packaging apparatus need be provided, thereby cutting down not only on the capital investment but on the floor space necessary to complete this operation. It is further known that in such mechanical apparatus, the more fluid or continuous the process, the less wear on both the apparatus and the package being handled. Thus it is the primary object of the subject invention to provide an apparatus for joining and sealing the tray and lid of a two-piece carton by bringing together and joining the separate components in one continuous process.

SUMMARY OF THE INVENTION

A lid sealing apparatus for a carton formed of a separate tray and lid wherein the apparatus conveys the tray in a continuous motion along a preselected path and feeds a lid after depositing glue thereon along a path to be positioned directly above the tray. Thereafter the lid side panels are folded down along the tray and held in position until fixed thereto by the setting of the glue.

BRIEF DESCRIPTION OF THE DRAWINGS

FIG. 2 is a plan view of the tray blank;

FIG. 3 is a perspective view of the formed tray;

FIG. 4 is a plan view of the lid blank;

FIG. 5 shows the manner of joining the lid blank and the tray to complete the carton;

DESCRIPTION OF THE INVENTION

Figure 1:
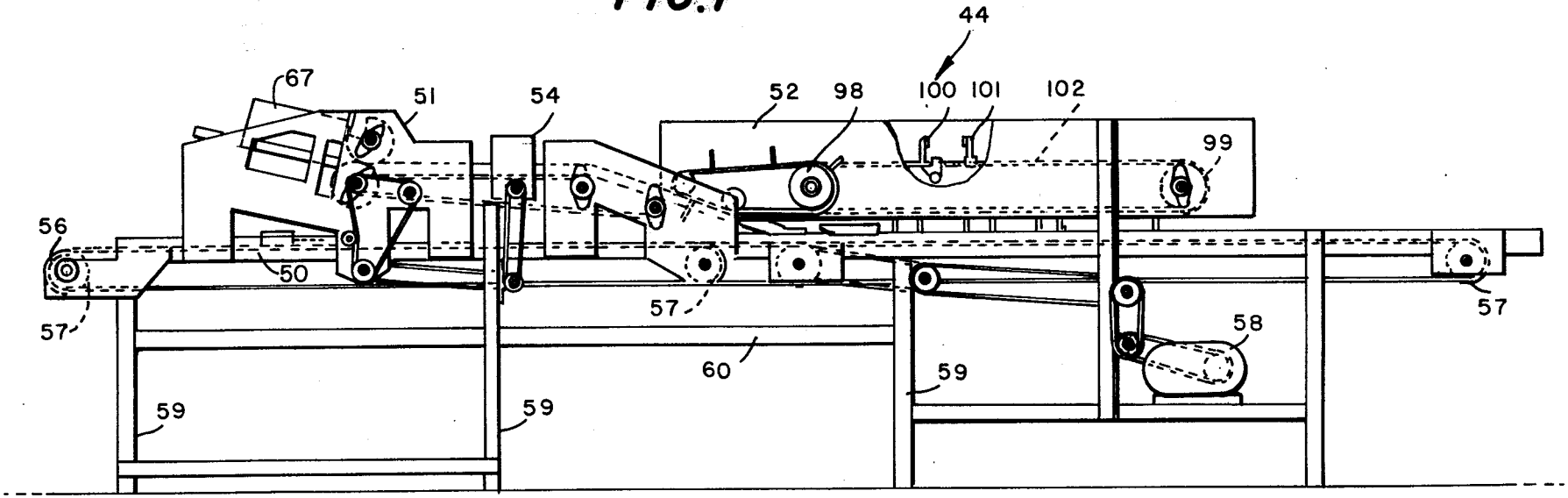
FIG. 1 is a side elevation view of the apparatus embodying the subject invention.
Figure 6:
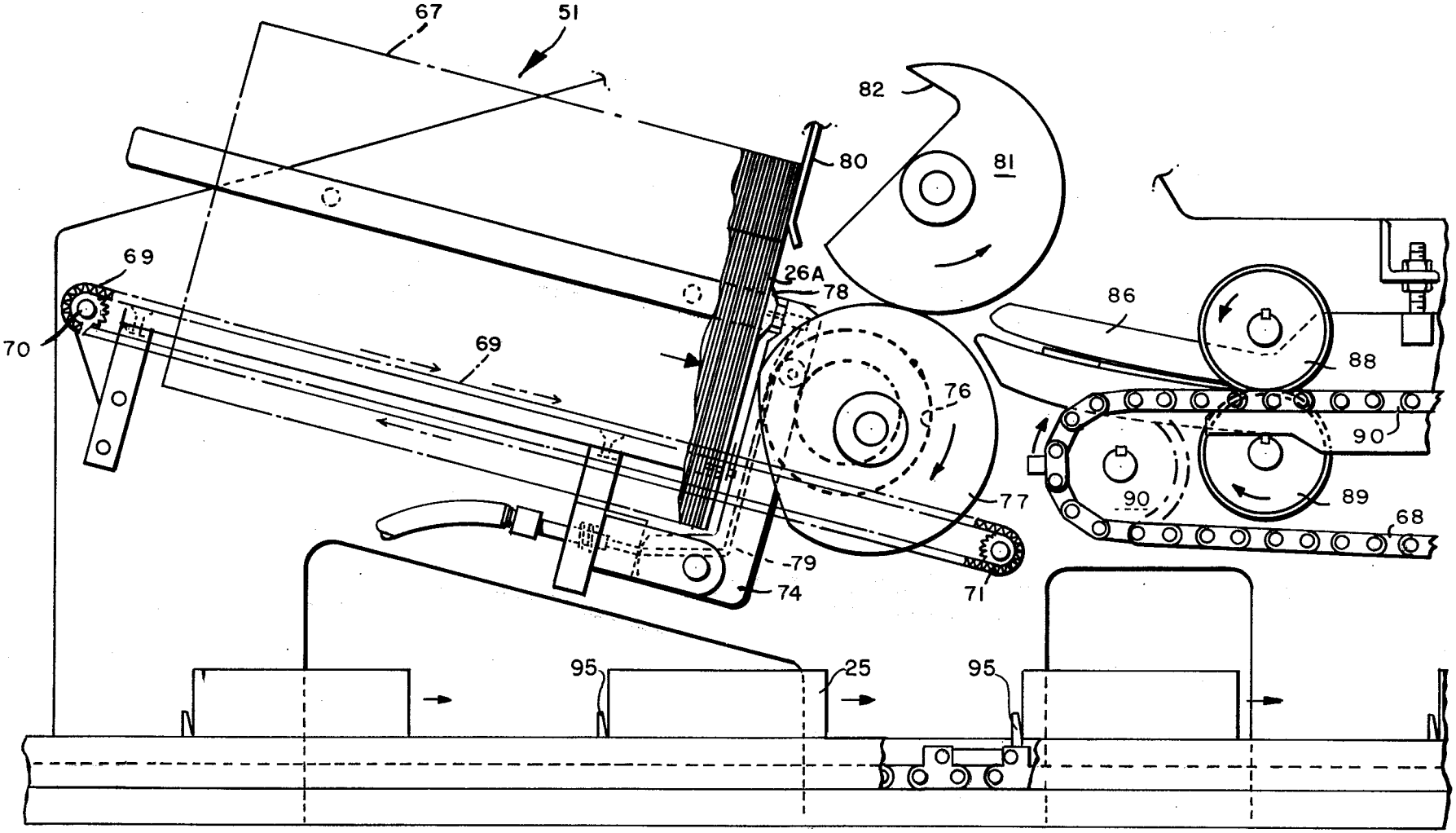
FIG. 6 is an enlarged view of the lid blank feeder.

In FIG. 1 is shown a side elevation view of the apparatus which receives a tray 25 (FIG. 3) after being filled with a suitable product to thereafter be sealed by a lid 26 (FIG. 4) placed thereover and fixed in position. The tray 25 is made from a blank (shown in FIG. 2) generally comprising a bottom panel 27, two end panels 28 and 29 and two side panels 30 and 31. The adjacent end and side panels are joined by gussets 32, 34, 35 and 36. The tray is formed by folding the gussets inward at the fold line 37 and gluing the gussets to the side walls as shown in FIG. 3.

After the appropriate produce or material is placed into the formed tray, the tray is sealed by fixing thereto the lid 26. This lid comprises a top panel 38 with attached side panels 39 and 40 which fold about the fold lines 41 and 42, respectively. Fixed to the ends of the top panel are the end panels 44 and 45 connected to the top panel at the fold lines 46 and 47, respectively.

Thus as shown in FIG. 5, the top or lid is placed over the open top of the tray 25 and the end panels 44 and 45 are folded downward about the fold lines to a position in contact with the tray end panels 28 and 29. Similarly the side panels 39 and 40 are folded downward to a position abutting the tray side panels 30 and 31. Prior to the folding, glue is deposited on the lid in positions on the side and end panels for fixing them to the respective side and end panels of the tray. Thus by holding the lid in the formed position for a short time the glue is permitted to set thereafter maintain the integrity of the formed carton.

In a normal packaging system the tray 25 is formed in an apparatus such as that disclosed in the previously-identified application Ser. No. 614,433, and entitled APPARATUS FOR FORMING TRAYS. The trays are thereafter fed through a filling station for the insertion of the product which is to be held by the carton. Of course the filling operation is substantially simplified by use of a two-piece carton since the tray can be manipulated without an attached lid being fixed to one edge. Thereafter the tray is fed to a device for accelerating and timing articles such as that described in application Ser. No. 614,336 identified heretofore which device accelerates the tray and also feeds the trays in spaced relationship forward along a conveyor belt.

In accordance with the present invention, there is provided an apparatus for receiving the folded trays and forming a lid thereon which lid has been previously exposed to a glue station so that once formed it adheres to the tray to form the sealed carton. For that purpose the cartons are fed along a feed conveyor in spaced relationship to a detecting station 50 (FIG. 1) which senses the passage of a tray and activates a lid blank feeding mechanism 51 to initiate movement of a lid blank along a path intersecting that of the tray at the merging station 52. Prior to this time the lid has passed through a gluing station 54 for the depositing of glue on one surface of the side and end flaps of the lid.

After the merging of the lid and the tray, the combination is passed through a forming station which bends the front flap 44 of the lid down along the front side 28 of the tray. Thereafter the side flaps 39 and 40 of the lid are pressed along the surfaces of the sides 30 and 31 of the tray followed immediately by the bending of the end flap 45 of the lid along the end wall 29 of the tray. The tray and lid are maintained in this position momentarily as the combination is moved along the conveyor feed path for a sufficient time duration to permit the glue previously deposited on the surface of the lid to adhere to the adjacent sidewall of the tray and thereby maintain the tray and lid in one integral carton for sealing the product therein. Thereafter the carton is transported along an outfeed conveyor for packing.

To explain the functioning of the carton forming apparatus 49, reference should be made primarily to FIGS. 1, 6, 7 and 8. As shown in FIG. 1, the tray is received and transported through the apparatus 49 by a feed conveyor 55. This feed conveyor comprises an endless chain 56 extending lengthwse through the apparatus and forming a preselected path along which the tray will move. The chain is constructed to present a flat surface on which the tray rests. Side guides (not shown) maintain the tray in alignment on the conveyor.

The conveyor 56 is supported on a plurality of sprockets 57 spaced across the apparatus with one sprocket being driven from a powered gear box 58 mounted on the apparatus. The apparatus itself is supported on a plurality of upright legs 59 with suitable cross braces 60 so as to support it in a horizontal position above the floor. Thus the tray is conveyed along the preselected path past the sensing station 50 which includes a switch for detecting the presence of a tray. As a tray passes, the lid blank feeder 51 is actuated to initiate movement of a lid along a path intercepting that of the tray. Naturally the lid blank 26 must be moved simultaneous with the tray so as to position it directly over the tray at the merging station 52.

In the lid blank station 51 the blanks are placed in a stack 67 on to the blank feeding mechanism which in turn feeds them singularly to a conveyor 68 for transmittal forward in timed relationship with a corresponding tray. The blanks are stacked individually on edge with each being supported on the side flaps with one end flap 29 extending down between a pair of parallel-spaced feed chains 69. These chains serve as means for progressing the blanks to the pickup position and are supported between pairs of sprockets 70 and 71 with one sprocket being power driven through a one-way clutch (not shown). The chains are driven such that they progress the stack of blanks from left to right in the drawings. The feed chains have a relatively smooth surface and slip past the blanks if the blanks in fact are stacked tightly together to thereby maintain the stack closely against the feeding apparatus.

Thus, one by one the blanks are shifted to the position of the lowermost end blank 26A which is next to be drawn from the stack. For drawing the first blank from the stack, a suction arm 74 pivots toward and away from the stack as a cam follower 75 rides within a groove 76 in a drive wheel 77. This drive wheel is power-driven by the gearbox 58 in a manner similar to the other mechanisms. Thus with rotation of the drive wheel 77 the suction arm 74 is brought into the position shown such that the suction cup 78 contacts the first blank 26A. At the same time a vacuum pressure is drawn through the connecting passage 79 leading to the center of the suction cup to cause firm attachment to this blank for pulling it from the stack such that it clears the top stop 80. The vacuum supply is interrupted if no tray is sensed at the sensing station 50 thereby preventing the feeding of a lid blank if no tray is on the conveyor.

As the end of the blank 26A slips by the stop 80, the grip wheel 81 which is rotated in unison with the grip wheel 77 turns to a position such that the lip 82 moves behind and pushes the blank end between these adjacent grip wheels. Simultaneously pressured air is fed through the passage 84 in the stop 80 to break any vacuum pressure between adjacent blanks. Thus the blank is fed between the parallel guides 86 and 87 and the feed wheels 88 and 89 to a position extending parallel to and immediately above a feed chain 68. The feed chain 68 rotates about a sprocket 90 and carries a plurality of spaced lugs 91 such that one lug being centrally positioned on the path of the blank moves into contact with the trailing edge of the end flap to push the blank forward along the path of the chains. Guides on each side of the chain 68 maintain the lid blank in the chain. For a more complete description of this apparatus, reference can be made to the above-mentioned application Ser. No. 614,352, entitled TRAY BLANK FEEDER.

As the lid blanks are propelled by the chain 68, they are treated by passage through a glue station 54 so the lid surfaces will adhere to the adjacent tray surfaces. This station comprises a reservoir 92 for liquid glue in communication with a wheel 93 having passages therein in a standard well-known manner to deposit glue in a predetermined pattern on the surfaces of the side and end flaps. Such glue stations are well known. Also it is possible to utilize a heat seal instead of gluing the lid on to the tray. For this purpose there would be substituted for the glue station a heating element treating the blank by raising the temperature of desired portions until the surface becomes tacky so it will adhere to adjacent tray surfaces.

Figure 7:
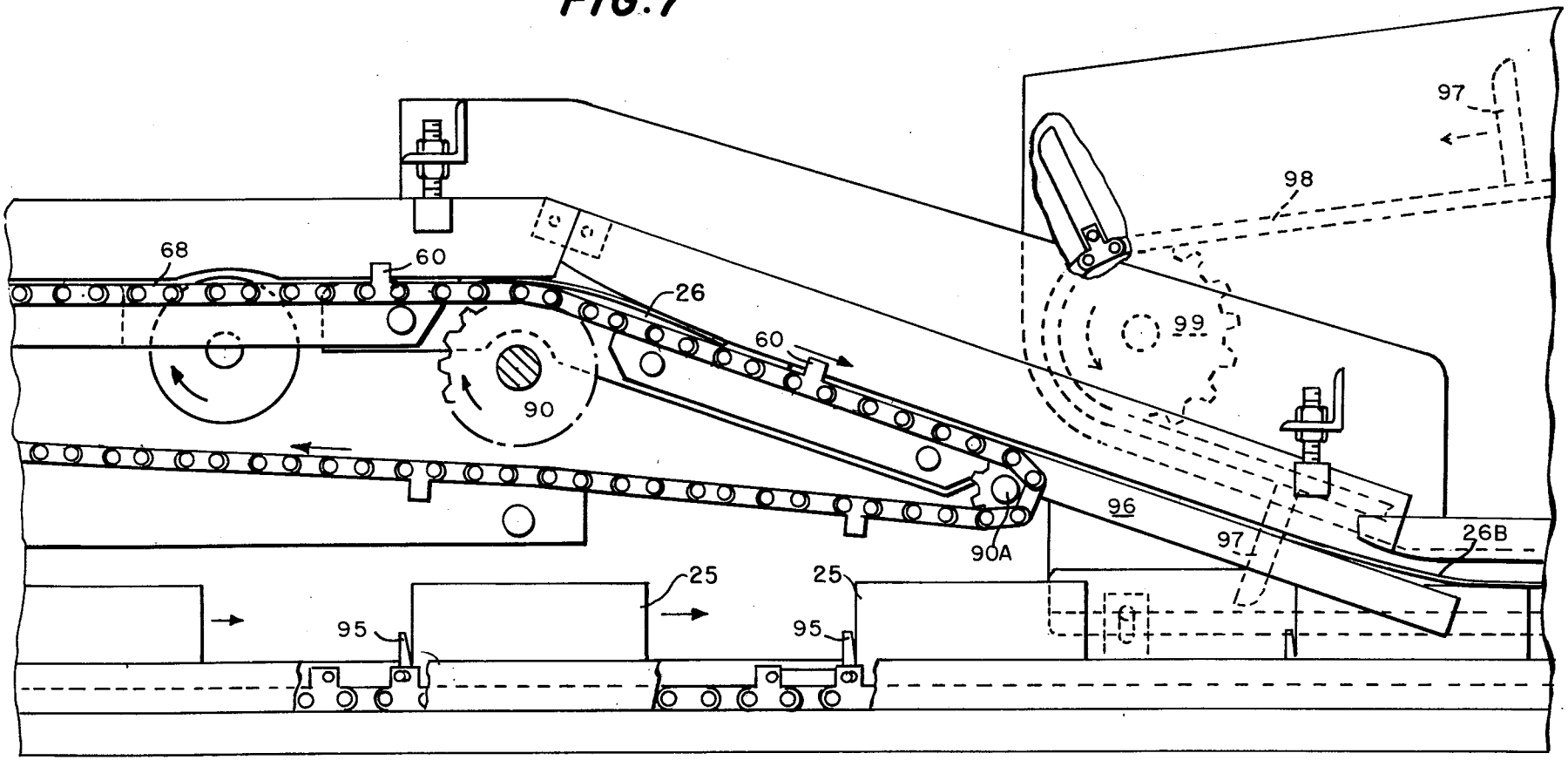
FIG. 7 is an enlarged view of the station for bringing the lid and tray together.
Figure 8:
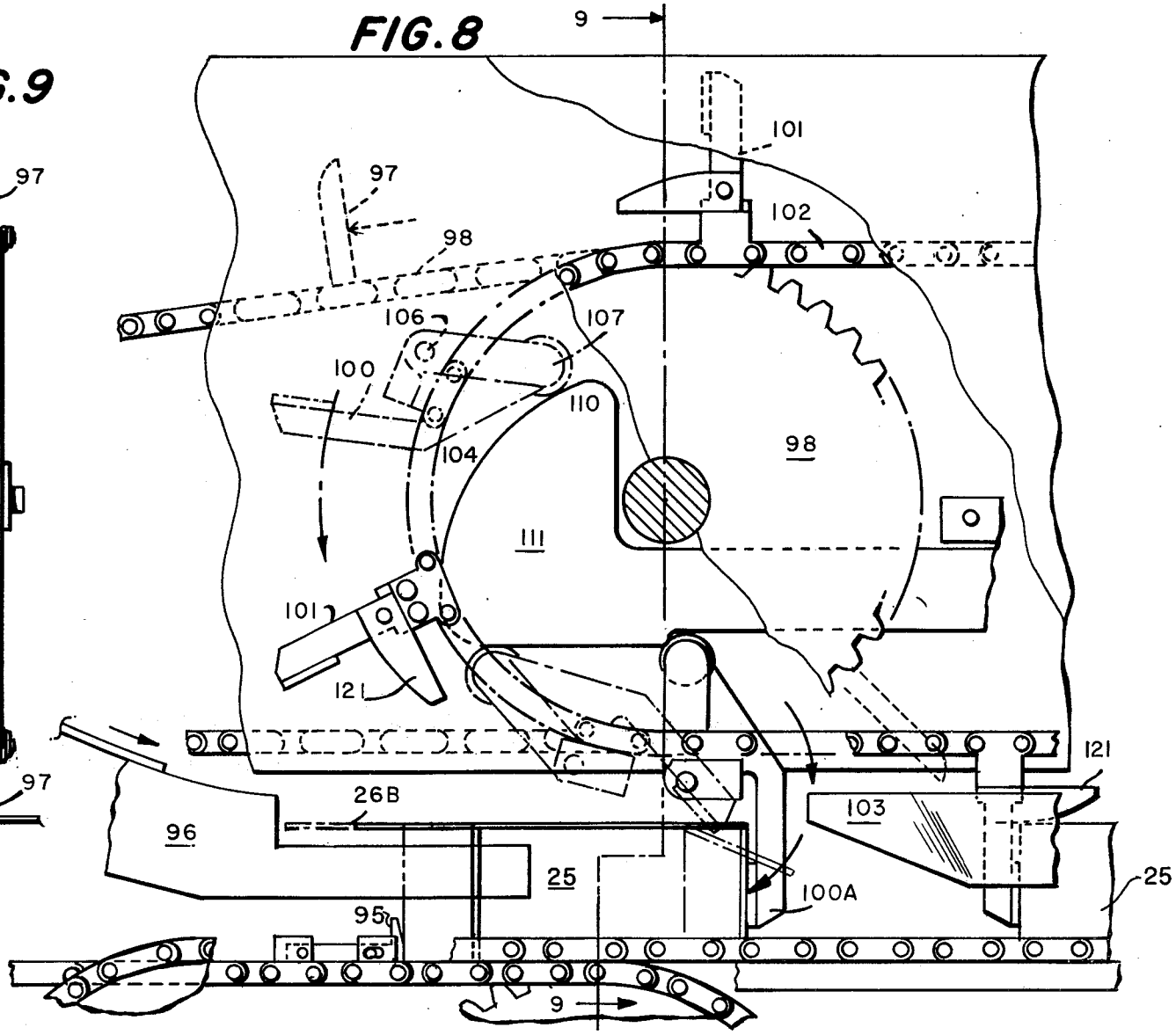
FIG. 8 is an enlarged side view of the mechanism for forming the lid around the tray.
Figure 9:
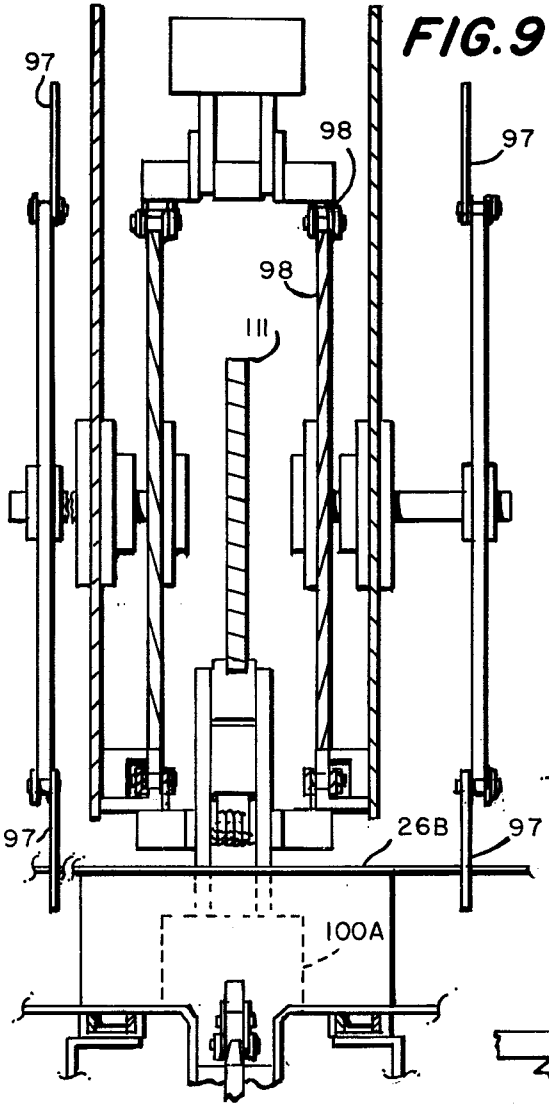
FIG. 9 is a cross-sectional view along the line 9—9 of FIG. 8.

As the tray and associated lid blank enter the merging station, the tray moves along the conveyor 56 by being pushed at the trailing edge by a series of lugs 95 bearing against the trailing edge of the tray. In timed sequence with the movement of the tray the lid blank is pushed by the lug 60 on the chain 68 so that it slides down along a pair of parallel spaced guides 96 extending at an angle of approximately 20° to the conveyor 68. As the lid blank reaches the point where the trailing edge passes the sprocket 90A, the lug 60 moves downward away from the lid blank in timed sequence with the arrival of pusher lugs 97 carried by the chains 98 supported about a plurality of sprockets 99. These pusher lugs continue forward movement of the lid blank as it slides down along the guides 96 and comes to a position directly above the corresponding tray as shown in FIGS. 7 and 8. Side guides along the conveyors maintain the blanks in alignment with the intended path.

At this point it is necessary to bend the two end flaps and the two side flaps downward over the sides of the tray and hold them in that position for a sufficient length of time for the glud previously deposited on these flaps to cause adherence to the tray sides. In the sequence of events it is very important to closely orient the lid over the tray such that the lid will be caused to bend at the fold lines 41, 42, 46 and 47. With the bending of the lid at these fold lines the side and end flaps will extend parallel and in abutting relationship to the adjacent side walls of the tray. For this purpose, the front or leading end flap 44 is first bent downward along the tray side 28 which action serves to closely orient the lid in alignment with the tray. Following this action, the side flaps 39 and 40 are plowed downward to positions in contact with the adjacent tray sides 30 and 31. Thereafter the trailing end flap 45 of the lid is bent downward to an abutting relationship with the trailing end wall 29 of the tray.

For forming the lid blank over the tray a plurality of combinations of forming members comprising the levers 100 and arms 101 which are timed and spaced to bear against the opposite end flaps of the lid blank and press them downward into a position parallel to the front and back panels of the tray. Thereafter the side panels of the tray are plowed downward by deflectors 103 (FIG. 5) through which the tray is passed as it is propelled forward. Accordingly, there is positioned above the path of the tray and in parallel relationship to the conveyor 56 the pair of parallel positioned endless chains 102 supported between pairs of spaced sprockets 98 and 99. The sprocket 99 is power driven such that the chains 102 are driven in the counterclockwise direction with the lower segment thereof extending just above the preselected path for the tray and lid blank.

Carried by the chains 102 are a plurality of levers 100 which are timed to swing down in front of each tray as shown in FIG. 8 to press the forward end flap 44 to a position parallel to the end panel 28 of the tray and hold it for a sufficient time for the glue to set. In swinging downward to a position encountering the tray, provision must be made for the lever 100 to clear the lid blank on top of the tray prior to being swung into contact for bending the forward lid flap. For this purpose the lever 100 includes a stud 104 fixed to the drive chains 102. Pivotally connected to these studs are links 105 held by the shaft 106. The lever 100 is pivotally fixed to these links by a shaft 107 such that the lever 100 is pivotally supported relative to the supporting endless chains. A coil spring 109 is looped around the shaft 106 in a manner to spring bias the lever 100 to the position extending perpendicular to the endless chains 102.

However, as the lever 100 and supporting linkage approaches the sprocket 98 a roller wheel 110 is supported on the shaft 107 between the links 105, encounters the cam member 111 supported between the sprockets. As the roller 110 rides around the surface of the cam it is forced to a position adjacent the supporting endless chain by overcoming the spring 109 thereby causing the lever 100 to pivot to a position adjacent and parallel to the supporting chains. Such action permits the lever to swing around the sprockets 98 and clear the top of the adjacent tray and lid blank. Thereafter the cam roller 10 allows the spring once again to cause the lever to be pivoted to a position perpendicular to the chain as the chain moves away from the camming member 111 thereby allowing it to swing to the position of the lever 100A shown in FIG. 8 to force the end flap 44 down along the end panel 28 of the tray. This action causes the forward panel to be bent and held along the adjacent side of the tray as it moves along the path on the forming conveyor.

Figure 12:
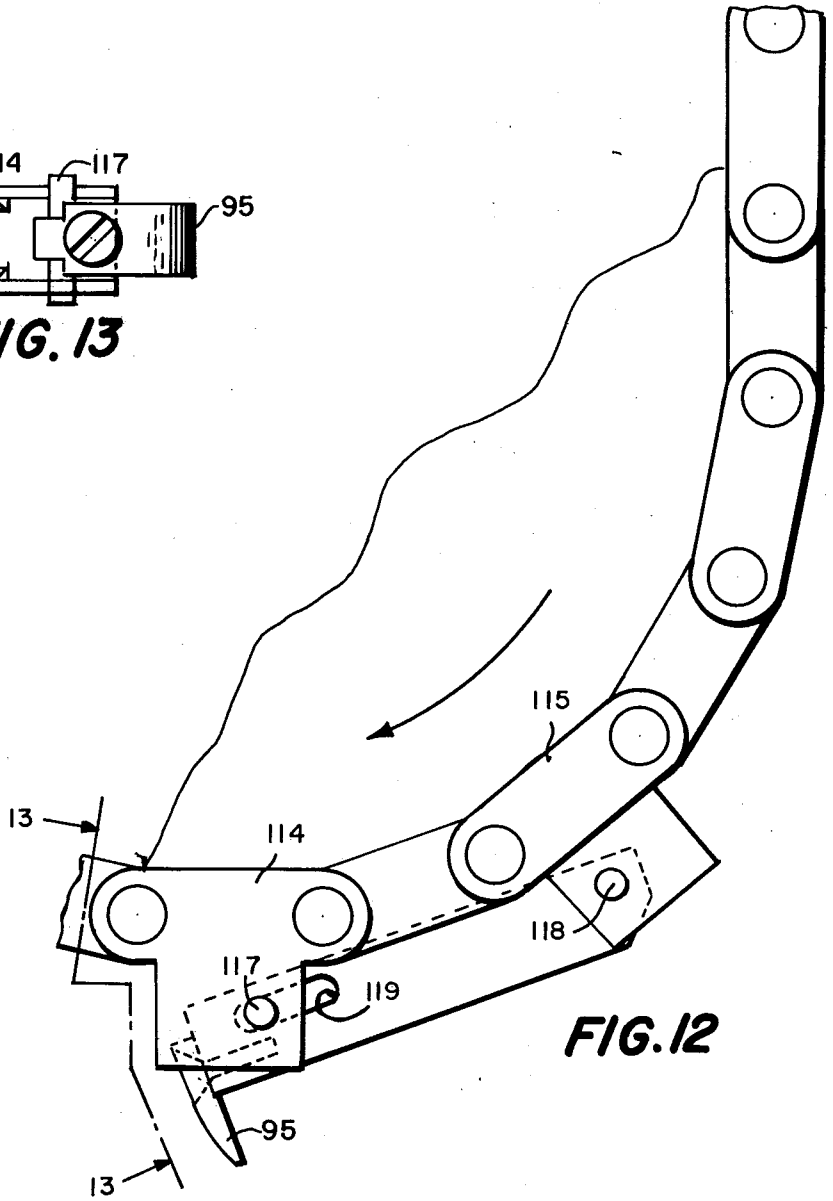
FIG. 12 is an enlarged partial view of the tray conveyor and lug.
Figure 13:
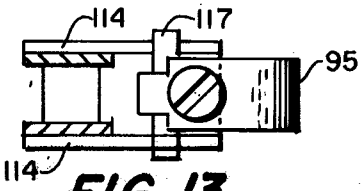
FIG. 13 is a cross-sectional view along the line 13—13 of FIG. 12.
Figure 10:
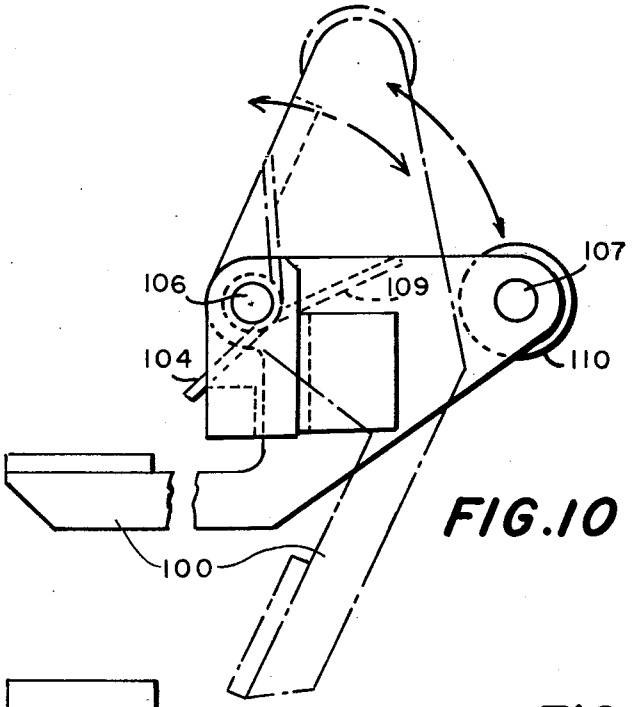
FIG. 10 is an enlarged view of the lid bending arm.
Figure 11:
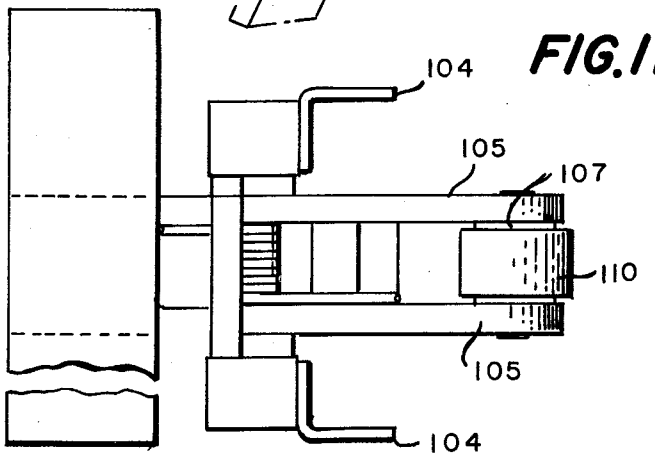
FIG. 11 is an end view of the lid bending arm shown in FIG. 10.

Now that the tray is being conveyed forward by the forming conveyor there is no longer need for the lugs 95 pushing the tray. In fact, these lugs must be swung from position just prior to the movement to the post 101 for clearance to allow folding the end flap 45 downward. For this purpose each lug is supported on the spaced links of the chain on a foot 114 as shown in FIGS. 12 and 13 wherein the uprights are positioned in pairs on each side of the chain. The lugs 95 each are supported as an extension of a foot held between the shafts 117 and 118. The shaft 118 extends through an opening in the foot closely fitting the outer diameter of the pin while the pin 117 is mounted in a slot 119. Thus as the chain starts its path around the trailing end sprocket 59 supporting the main conveyor chain the speed of the post is maintained by the pushing action of the trailing link 115 while the link 114 pulls the pin 117 downward around the sprocket and out of contact with the tray. In this manner each lug 95 is caused to clear the trailing edge of the accompanying tray prior to the contact of the arm 101 for bending the trailing end flap of the lid downward.

After the forward flap 44 has been bent downward to a position adjacent the end wall 28 of the tray, forward movement of the tray and lid will bring the side flaps 39 and 40 into contact with the plows 103 spaced to each side of the predetermined path of the tray. With this action these plows will initiate and complete bending of the side flaps 39 and 40 to positions adjacent the side walls 30 and 31 of the tray. The plows are sufficiently long to hold the side walls in that attitude for a sufficient time for the glue to set. During substantially the same time, the trailing arm 101 immediately adjacent to the lever 100 and also carried by the chains 102 swings downward to a vertical attitude and in so swinging is brought into contact with the trailing end flap 45 of the lid. During this time a projection 121 extending forward from the arm pushes the lid center downward to prevent bowing for proper positioning of the lid on the tray. Thus as the chains 102 proceed parallel to and just above the tray, the forward lever 100 and the trailing arm 101 continue in contact with the lid end flaps to hold them in place for sufficient time for the glue to set. Thereafter as the leading lever 100 and arm 101 pass around the trailing sprocket 99 these members swing to a position out of contact with the tray and permit it to proceed on the conveyor to exit the apparatus. Just prior to removal of the pusher lug 95 a second conveying chain (not shown) is brought under the tray. This chain comprises two parallel smooth top chains running at the same speed as the previous conveyors to carry the completed carton away from the apparatus.

Thus it can be seen that there is provided in one continuous operation the forming and marrying of the lid to the tray in a manner suitable for sealing the tray with the lid properly draped thereover.

The invention claimed is:

1. A method for sealing a lid onto a tray to form a carton wherein the tray comprises a multi-sided container with an open top and the lid comprises a center panel having pairs of side and end flaps adapted to bend down along the tray sides, said method comprising:

conveying the tray along a preselected path;

feeding a tray blank along a path elevated above the tray preselected path and positioning said lid blank above the tray such that the center panel thereof coincides with the tray outline;

treating one surface of each lid blank side panel prior to positioning the lid blank over the tray so the surface will stick to the tray;

folding the panel extending in the direction the lid blank and tray are being moved down along the adjacent tray side and holding said panel in said position so as to position the lid blank center and precisely over the tray; and folding the remaining lid blank side panels down along the adjacent sides of the tray.

2. A method for sealing a carton as defined in claim 1 wherein after said leading end panel of the lid blank is folded down along the side of the tray the lid blank side panels are simultaneously folded to a position adjacent the tray sides followed by the step of folding the trailing end panel down along the side of the tray.

3. A method for sealing a carton as defined in claim 2 wherein the top panel of the lid blank is forced downward after the leading end panel is folded downward but before the additional panels are folded to prevent the top panel from bending during the folding of the subsequent panels.

4. A method for sealing a lid onto a tray to form a carton wherein the tray comprises a multi-sided container with an open top and the lid comprises a center panel having pairs of side and end flaps adapted to bend down along the tray sides, said method comprising:

conveying the tray along a preselected path;

feeding a tray blank along a path elevated above the tray preselected path and positioning said lid blank loosely on the tray such that the center panel thereof coincides with the tray outline;

folding one flap down along the adjacent tray side while the blank is lying loosely on the tray and holding said flap in said position so as to position the lid blank center panel precisely over the tray; and folding the remaining lid blank side panels down along the adjacent sides of the tray.

5. A method for forming a carton as defined in claim 4 including the step of treating one surface of each lid blank side panel prior to positioning the lid blank over the tray so the surface will stick to the tray side.

6. A lid sealing apparatus for a carton including a tray and a separate lid formed from a blank including a top panel and a plurality of side panels adapted to overlap the sides of the tray and be fixed thereto, said apparatus comprising:

means for conveying said trays in single-file order along a preselected path comprising a first endless chain with lugs thereon which propel the tray forward, means for feeding said lid blanks in single-file order along the path intercepting the preselected path of the trays such that one lid blank is positioned above each tray;

lid forming means for pressing the lid side panels downward into contact with the adjacent sides of the tray comprising a plurality of forming members supported in spaced relationship on a second endless chain positioned above the tray conveying means and operable to contact and push down on the lid flaps for bending the flaps to a position along the side of the tray to fix the lid to the tray for sealing the carton; and said first endless chain for conveying said trays terminating after said lid forming members contact the lid blank.

7. A lid sealing apparatus as defined in claim 6 including a third conveyor for receiving the carton from the lid forming means for conveying the carton out of the apparatus.

8. A lid sealing apparatus as defined in claim 7 wherein said first endless chain includes lug means which swing out of position contacting the carton just prior to the lid forming means contacting the lid blank so as not to interfere with the folding of the lid blank.

9. A method for sealing a lid onto a tray to form a carton wherein the tray comprises a multi-sided container with an open top and the lid blank comprises a center panel and side flaps adapted to bend down along the tray sides, said method comprising:

conveying the tray along a preselected path in single file order by tray conveying means;

feeding the lid blanks along a path elevated above the preselected path and conveying one lid blank to a position above each tray such that the center panel coincides with the tray outline;

treating the lid side flaps so said flaps will stick to the tray;

folding the lid flaps down along the tray sides; and terminating the conveyance of the tray by the tray conveying means after the lid folding operation is initiated.

* * * * *